US007862493B2

(12) United States Patent
Haider et al.

(10) Patent No.: US 7,862,493 B2
(45) Date of Patent: Jan. 4, 2011

(54) CENTRIFUGE FOR CONTINUOUS SEPARATION OF FLOWABLE SUBSTANCES OF DIFFERENT DENSITIES HAVING AN AIR EXTRACTION MEMBER

(76) Inventors: Guenter Haider, Braunsberger Weg 18, Vilsbiburg (DE) 84137; Klaus Klinger, Michael-Jaeger-Str. 16, Vilsbiburg (DE) 84137

( * ) Notice: Subject to any disclaimer, the term of this patent is extended or adjusted under 35 U.S.C. 154(b) by 32 days.

(21) Appl. No.: 11/915,384

(22) PCT Filed: May 3, 2006 (Under 37 CFR 1.47)

(86) PCT No.: PCT/EP2006/062026

§ 371 (c)(1), (2), (4) Date: Nov. 7, 2008

(87) PCT Pub. No.: WO2006/131425

PCT Pub. Date: Dec. 14, 2006

(65) Prior Publication Data

US 2009/0215604 A1 Aug. 27, 2009

(30) Foreign Application Priority Data

Jun. 4, 2005 (DE) ..... 10 2005 025 784

(51) Int. Cl.
*B04B 1/20* (2006.01)

(52) U.S. Cl. ..... 494/53

(58) Field of Classification Search ..... 494/52–54, 494/56, 84; 210/377, 380.1, 380.3
See application file for complete search history.

(56) References Cited

U.S. PATENT DOCUMENTS

| | | | | | |
|---|---|---|---|---|---|
| 2,679,974 | A | * | 6/1954 | Gooch | 494/15 |
| 2,703,676 | A | * | 3/1955 | Gooch | 494/42 |
| 3,096,282 | A | * | 7/1963 | Trotter, Jr. | 494/45 |
| 3,228,592 | A | * | 1/1966 | Shapiro | 494/51 |
| 3,398,888 | A | * | 8/1968 | Koenecke et al. | 494/11 |
| 3,428,246 | A | * | 2/1969 | Finkelston | 494/27 |
| 3,568,920 | A | * | 3/1971 | Nielsen | 494/53 |
| 5,354,255 | A | * | 10/1994 | Shapiro | 494/53 |
| 5,364,335 | A | * | 11/1994 | Franzen et al. | 494/15 |

(Continued)

FOREIGN PATENT DOCUMENTS

DE 2057555 * 6/1972

(Continued)

*Primary Examiner*—Charles E Cooley
(74) *Attorney, Agent, or Firm*—Themis Law

(57) ABSTRACT

A screw centrifuge for the continuous separation of flowable substances of different densities includes a rotor drum having discharge openings for the heavy phase that are arranged in a conical portion of the rotor wall, and weir openings for the light phase that are provided on an end wall of the rotor drum. A conveyor screw is rotatable inside the rotor drum and has a screw blade mounted on a hollow shaft for transporting the heavy phase to the discharge openings. A mixture inflow tube is arranged coaxially inside the hollow shaft and leads to a feed chamber in the hollow shaft that is in flow communication with the screw blade. An air extraction member is provided before the feed chamber and generates, in the annular space enclosing the inflow tube, a suction flow co-directional with the delivery direction in the inflow tube.

7 Claims, 2 Drawing Sheets

U.S. PATENT DOCUMENTS

| | | | | | |
|---|---|---|---|---|---|
| 5,374,234 | A | * | 12/1994 | Madsen | 494/53 |
| 5,380,266 | A | * | 1/1995 | Leung et al. | 494/53 |
| 5,401,423 | A | * | 3/1995 | Leung et al. | 210/787 |
| 5,403,486 | A | * | 4/1995 | Leung | 210/512.1 |
| 5,423,734 | A | * | 6/1995 | Leung | 494/53 |
| 5,520,605 | A | * | 5/1996 | Leung et al. | 494/50 |
| 5,527,258 | A | * | 6/1996 | Leung et al. | 494/53 |
| 5,527,474 | A | * | 6/1996 | Leung | 210/787 |
| 5,551,943 | A | * | 9/1996 | Leung et al. | 494/53 |
| 5,658,232 | A | * | 8/1997 | Leung | 494/50 |
| 5,683,343 | A | * | 11/1997 | Leung | 494/52 |
| 5,769,776 | A | * | 6/1998 | Leung et al. | 494/53 |
| 5,792,039 | A | * | 8/1998 | Green et al. | 494/54 |
| 5,840,006 | A | * | 11/1998 | Leung et al. | 494/53 |
| 5,971,907 | A | * | 10/1999 | Johannemann et al. | 494/37 |
| 6,077,210 | A | * | 6/2000 | Leung et al. | 494/53 |
| 6,561,965 | B1 | * | 5/2003 | Corner-Walker et al. | 494/53 |
| 6,605,029 | B1 | * | 8/2003 | Koch et al. | 494/53 |
| 6,780,147 | B2 | * | 8/2004 | Koch et al. | 494/53 |
| 6,790,169 | B2 | * | 9/2004 | Koch et al. | 494/53 |
| 7,001,324 | B2 | * | 2/2006 | Hensley et al. | 494/53 |
| 7,018,326 | B2 | * | 3/2006 | Koch et al. | 494/53 |
| 7,060,019 | B2 | * | 6/2006 | Hermeler et al. | 494/53 |
| 7,247,133 | B2 | * | 7/2007 | Gronnegaard et al. | 494/53 |
| 7,282,019 | B2 | * | 10/2007 | Lantz | 494/54 |
| 2004/0029697 | A1 | * | 2/2004 | Hermeler et al. | 494/53 |
| 2004/0167005 | A1 | * | 8/2004 | Hensley et al. | 494/53 |
| 2005/0245381 | A1 | * | 11/2005 | Tettleton et al. | 494/53 |
| 2006/0240966 | A1 | * | 10/2006 | Lantz | 494/54 |

FOREIGN PATENT DOCUMENTS

| | | | | |
|---|---|---|---|---|
| DE | 2152839 | | * | 4/1973 |
| DE | 3723864 | A1 | * | 1/1989 |
| DE | 4217801 | | | 12/1993 |
| JP | 02160063 | A | * | 6/1990 |
| JP | 2004290832 | A | * | 10/2004 |
| JP | 2004290833 | A | * | 10/2004 |

* cited by examiner 58
62
64
II
II
r
D
60
40
28

40
$v_1$
III
60
28
36
30
34
38
32
v
III
64
44
42
26

CENTRIFUGE FOR CONTINUOUS SEPARATION OF FLOWABLE SUBSTANCES OF DIFFERENT DENSITIES HAVING AN AIR EXTRACTION MEMBER

FIELD OF THE INVENTION

The present invention relates to a screw centrifuge for the continuous separation of flowable substances of different densities. More particularly, the present invention relates to a screw centrifuge, in which an air extraction member is provided before a feed chamber to generate a suction flow co-directional with the delivery direction of an inflow tube.

BACKGROUND OF THE INVENTION

In screw centrifuges for the continuous separation of flowable substances of different kinds, one critical area is where the mixture inflow tube leads into the feed chamber, since portions of the mixture may flow back, because of turbulence or excessive throughput, into the cavity of a hollow shaft of a conveying screw and become deposited inside a cavity of the conveying screw. To remedy this problem, in known designs openings are provided in the wall of the hollow shaft of the conveying screw, through which openings these product deposits can escape into the region of the screw blade. However, product deposits may over time become baked into such cavity and in particular into dead spaces thereof, and thus produce an imbalance on the rotating conveyor screw.

Attempts have therefore been made to circumvent the problem of product deposits in the comparatively large cavity of the conveyor screw by mounting inside the hollow shaft a protective tube through which the mixture inflow tube leads to the feed chamber. The problem is only partially solved in this fashion, however, since the danger still exists that the comparatively narrow annular space between the protective tube and the mixture inflow tube may become clogged with back-flowing portions of the mixture.

SUMMARY OF THE INVENTION

It is the object of the present invention to improve a screw centrifuge of the above construction to prevent backflows at the end of the inflow tube, so that deposits due to back-flowing portions of the mixture are effectively prevented.

To achieve this object, according to the present invention, an air extraction member is provided before the feed chamber in the delivery direction of the inflow tube, which member generates, in the annular space enclosing the inflow tube, a suction flow co-directional with the delivery direction in the inflow tube.

This suction flow at the outer periphery of the inflow tube prevents, with simple means, a backflow of portions of the mixture back into the cavity of the hollow shaft, since the suction flow counteracts any such backflow and prevents mixture particles from entering the annular space.

If, in one embodiment of the invention, the inflow tube extends through a protective tube that delimits the annular space from the cavity of the hollow shaft, the suction flow is considerably accelerated because of the comparatively small cross section of the annular space, more efficiently counteracting any undesired backflow.

In one embodiment of the invention, the air extraction member has a central entry region into which projects the end of the inflow tube leading to the feed chamber. In one variant of this embodiment that is relatively inexpensive due to its simple design, the air extraction member can be embodied as an impeller part of a centrifugal pump.

This impeller part can be embodied integrally with the hollow shaft and comprises suction channels that proceed from the central entry region and lead, with a profile curved oppositely to the rotation direction of the hollow shaft, to the screw blade.

The result of the invention is on the one hand that product deposits cannot settle in the comparatively large cavity of the hollow shaft, while simultaneously eliminating the danger that the comparatively narrow protective tube can be clogged by back-flowing portions of the product. The air extraction member ensures that during rotation of the conveyor screw, air is constantly being extracted through the annular space, which is thereby always ventilated and thus kept free of deposits.

BRIEF DESCRIPTION OF THE DRAWINGS

The invention is explained below with reference to an exemplifying embodiment that is depicted in the drawings, in which.

DETAILED DESCRIPTION OF AN EMBODIMENT OF THE INVENTION

Figure 1:
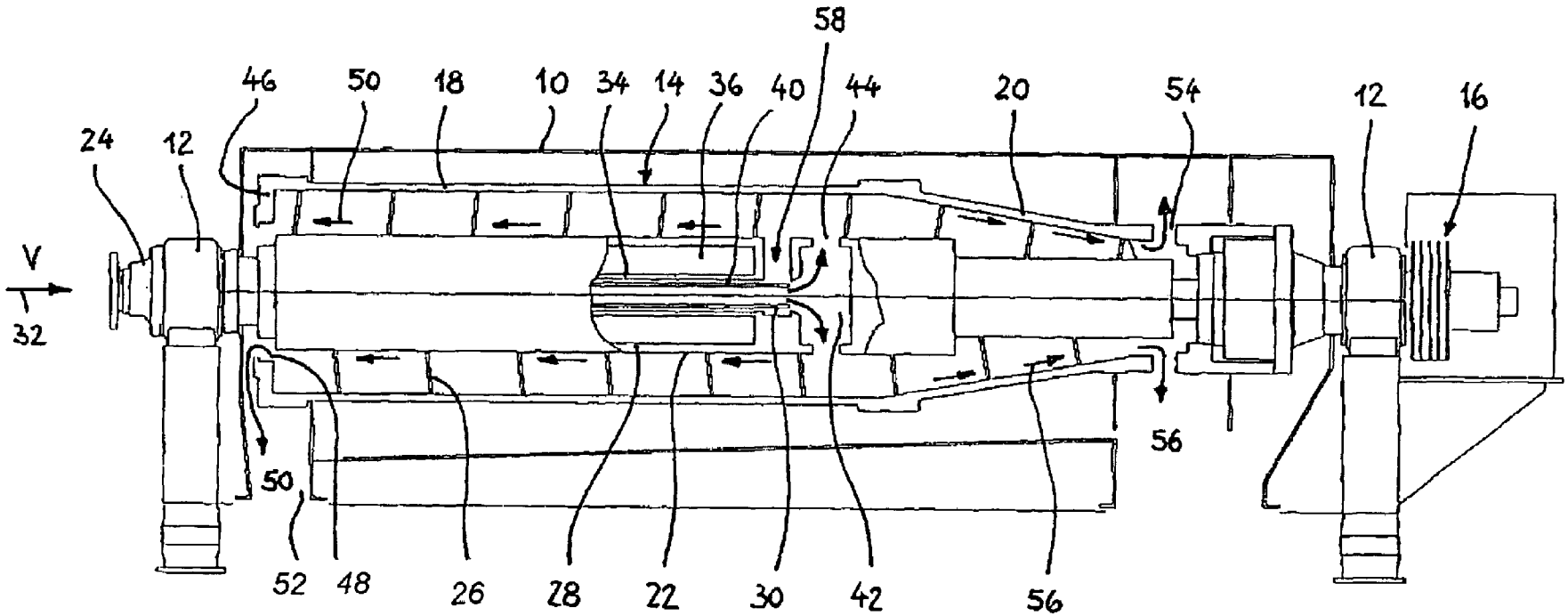
FIG. 1 is a schematic longitudinal section through a screw centrifuge according to the invention.

FIG. 1 illustrates a rotor drum 14 that is driven by a motor 16 rotatably journaled in bearings 12 in a housing 10 (only partially indicated). Rotor drum 14 is made up of a cylindrical portion 18 and a conical portion 20. Journaled rotatably in rotor drum 14 is a conveyor screw 22 that is driven by a motor 24 at a generally slightly higher rotation speed than rotor drum 14. Screw blade 26 of conveyor screw 24 is mounted on a hollow shaft 28, and is arranged so that the conveying direction is from cylindrical portion 18 toward conical portion 20.

Arranged inside hollow shaft 28 is an inflow tube 30 for the mixture to be separated, which enters inflow tube 30 in the direction of arrow 32. Inflow tube 30 extends through a coaxial protective tube 34 that is fixedly joined to hollow shaft 28 and delimits cavity 36 of hollow shaft 28 from annular space 38 (FIG. 2) that encloses inflow tube 30.

Free end 40 of inflow tube 30 leads into a feed chamber 42, configured in hollow shaft 28, from which radial feed openings 44 lead into the region of screw blade 26. In one embodiment, free end 40 of inflow tube 30 does not extend into feed chamber 42.

Cylindrical portion 18 of rotor drum 14 is closed off by an end wall 46 that has weir openings 48 for the output of light phase 50, which flows into an output conduit 52 of housing 10.

Provided in conical portion 20 of the rotor wall are discharge openings 54 for heavy phase 56, which is transported, in accordance with the arrows illustrated, from screw blade 26 to discharge openings 54.

Figure 3:
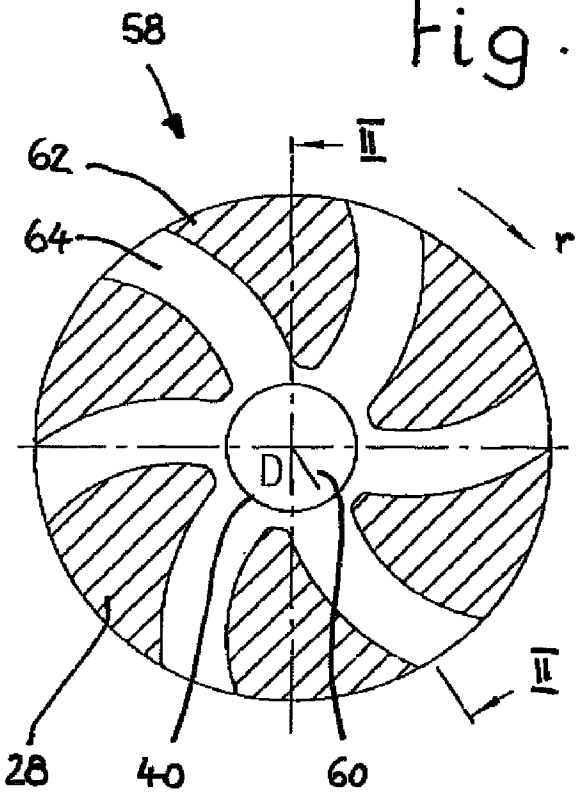
FIG. 3 is a cross section in plane III-III of FIG. 2.
Figure 2:
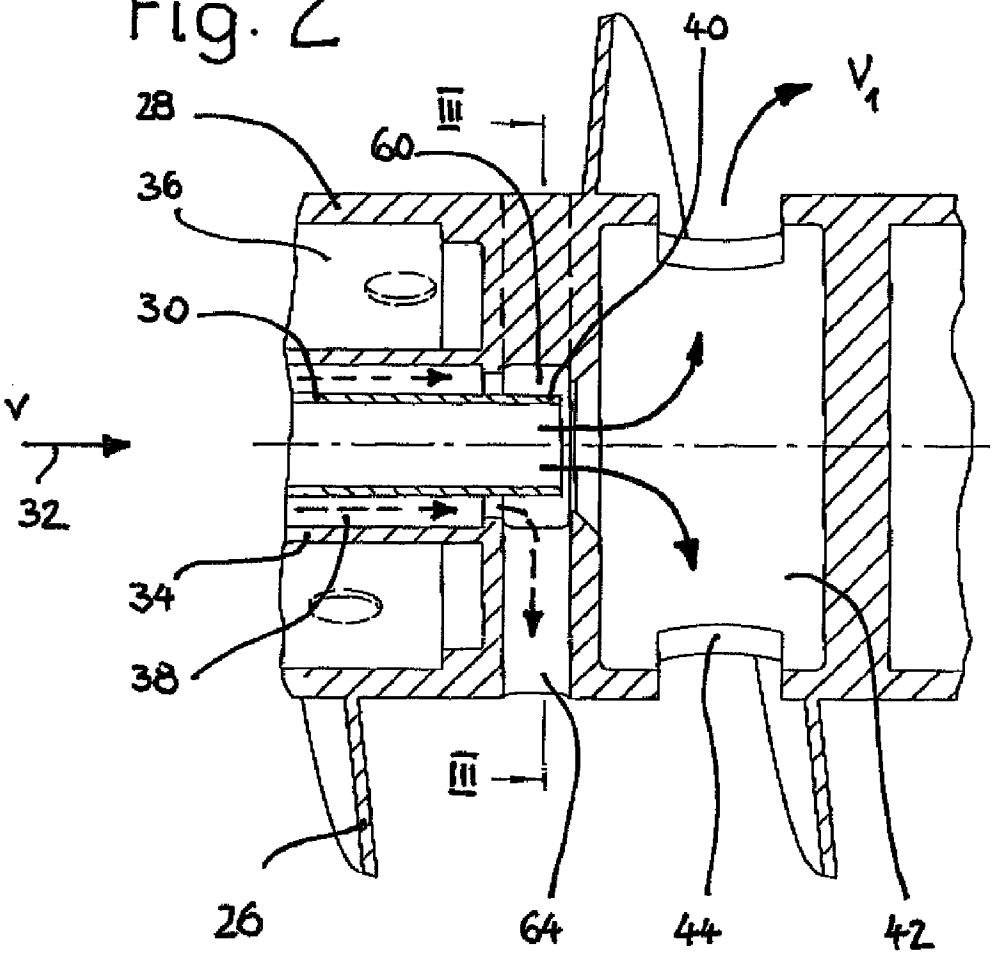
FIG. 2 is an enlarged partial depiction of the conveyor screw in the region of the feed chamber, corresponding to section II-II of FIG. 3.

The depictions in FIGS. 2 and 3, enlarged as compared with FIG. 1, show that an air extraction member 58 is provided before feed chamber 42 in delivery direction 32 of inflow tube 30, which member has a central entry region 60 into which end 40 of inflow tube 30 leading to feed chamber 42 projects. As is apparent in particular from FIG. 3, air extraction member 58 is embodied integrally with hollow shaft 28 as an impeller part 62 of a centrifugal pump. Impeller part 62 has suction channels 64 that proceed from central entry region 60 and lead, with a profile curved oppositely to rotation direction r (see FIG. 3) of hollow shaft 28, to screw blade 26. As shown in FIGS. 2 and 3, suction channels 64 are machined into hollow shaft 28.

When the screw centrifuge is in operation, the rotation of delivery screw 22 (and therefore of impeller part 62) ensures that a suction flow, drawn with dashed arrows in FIG. 2 and co-directional with delivery direction 32 in inflow tube 30, is constantly generated in annular space 38 between protective tube 34 and inflow tube 30. This suction flow effectively causes the portions of the mixture emerging from end 40 of inflow tube 30 to travel entirely into feed chamber 42, and cannot flow back into annular space 38. Annular space 38 is thereby constantly ventilated and kept free of deposits. Even if throughput V in inflow tube 30 is greater than throughput $V_1$ through discharge openings 44, the suction flow generated by impeller part 62 prevents a backup in annular space 38.

A further advantage is that the suction flow generated according to the present invention in the direction of the arrows drawn with dashed lines provides assistance in achieving high throughputs V, so that a large partial volume flow $V_1$ is forced by the centrifugal pump system, under pressure, into the region of screw blade 26.

The invention claimed is:

1. A screw centrifuge for continuous separation of flowable substances of different densities, comprising:

a rotor drum having discharge openings for a heavy phase that are arranged in a conical portion of the rotor drum, the rotor drum further having weir openings for a light phase that are provided on an end wall closing off the rotor drum;

a conveyor screw, rotatable inside the rotor drum, having a screw blade mounted on a hollow shaft for transport of the heavy phase to the discharge openings;

a mixture inflow tube arranged coaxially inside the hollow shaft, the mixture inflow tube leading to a feed chamber configured in the hollow shaft, from which feed openings lead to the screw blade, and a protective tube within which the inflow tube extends, the protective tube delimiting the annular space from a cavity within the hollow shaft, wherein an air extraction member is provided before the feed chamber in the delivery direction of the inflow tube, and wherein the air extraction member generates, in an annular space enclosing the inflow tube, a suction flow co-directional with the delivery direction in the inflow tube.

2. The screw centrifuge according to claim 1, wherein the protective tube is fixedly joined to the hollow shaft.

3. The screw centrifuge according to claim 1, wherein the air extraction member has a central entry region into which projects an end of the inflow tube leading to the feed chamber.

4. The screw centrifuge according to claim 3, wherein the air extraction member is an impeller part of a centrifugal pump.

5. The screw centrifuge according to claim 4, wherein the impeller part is embodied integrally with the hollow shaft and comprises suction channels that proceed from the central entry region and lead, with a profile curved oppositely to the rotation direction of the hollow shaft, to the screw blade.

6. The screw centrifuge according to claim 5, wherein the impeller part is formed by a solid element having the suction channels bored therein.

7. The screw centrifuge according to claim 3, wherein the end of the inflow tube does not extend into the feed chamber.

* * * * *